United States Patent [19]

Pierrat

[11] Patent Number: 4,891,914

[45] Date of Patent: Jan. 9, 1990

[54] COMPUTER CONTROLLED UNIVERSAL GRINDER AND METHOD FOR GRINDING TROCHOIDAL AND CIRCULAR BEARING RACES

[76] Inventor: Michel A. Pierrat, 277 Forrest La., Boulder, Colo. 80302

[21] Appl. No.: 368,912

[22] Filed: Jun. 19, 1989

Related U.S. Application Data

[63] Continuation of Ser. No. 176,846, Apr. 4, 1988, abandoned.

[51] Int. Cl.[4] ..... B25B 5/00

[52] U.S. Cl. ..... 51/105 R; 51/105 EC; 51/237 M; 51/291

[58] Field of Search ..... 51/105 R, 105 EC, 235, 51/290, 291 R, 237 R, 237 M, 165 R, 92 LH, 288, 326

[56] References Cited

U.S. PATENT DOCUMENTS

| | | | |
|---|---|---|---|
| 3,571,911 | 3/1971 | Littwin | 51/326 |
| 4,186,529 | 2/1980 | Huffman | 51/288 |
| 4,584,794 | 4/1986 | Hirohata | 51/326 |

*Primary Examiner*—Frederick R. Schmidt
*Assistant Examiner*—M. Rachoba
*Attorney, Agent, or Firm*—E. T. Barrett

[57] ABSTRACT

A grinding machine for grinding epitrochoidal, hypotrochoidal, and circular bearing races in one set-up without having to move the part and to insure near perfect concentricity between all of the bearing races.

A machine blank is mounted on an upper rotary table that is in turn mounted on a lower rotary table. The upper table is driven both by the lower table and by an independent servomotor. The net speed of the upper table is the difference between the two driving speeds of the tables. The axis of rotation of the upper table is capable of being offset from the axis of rotation of the lower table. The two tables are rotated in opposite directions while a grinding wheel is moved laterally into contact with the surface of a rough-machined part to form thr trochoidal surface. The characteristics are determined by the amount of the offset, the diameter of any rollers that are to be positioned between the trochoidal surfaces in the speed change device, and the relative speeds of the two tables. After the trochoidal surface or surfaces are completed, the lower table is stopped in its home position and the upper table is driven in order to grind the circular bearing race or races. Three independently-driven grinding spindles are provided.

8 Claims, 3 Drawing Sheets

COMPUTER CONTROLLED UNIVERSAL GRINDER AND METHOD FOR GRINDING TROCHOIDAL AND CIRCULAR BEARING RACES

This application is a continuation of application Ser. No. 176,846 filed Apr. 4, 1988, now abandoned.

BACKGROUND OF THE INVENTION

1. Field of the Invention:

This invention relates to machines for making parts in which two or more parts have shaped surfaces that must bear a precision relationship. More particularly this invention relates to machines for making parts having both trochoidal and circular surfaces that must be positioned in precision relationship to each other. Such machines are useful in speed change devices and other units having a plurality of shaped surfaces which must have a near perfect eccentricity between all of the shaped surfaces.

2. Description of the Related Art:

Speed change devices having both hypotrochoidal and epitrochoidal surfaces that must bear predetermined precision positions in relation to each other and to circular bearing races are described in U.S. Pat. No. 4,584,904 to Distin and Shaffer and U.S. Pat. No. 4,643,047 to Distin. The speed change devices described in those patents make use of rollers positioned between adjacent epitrochoidal and hypotrochoidal bearing races to reduce friction and backlash. Grinding machines for making such parts typically are capable of grinding only one surface without making a new set-up. In speed change devices made by such a method it is difficult or impossible to maintain the degree of concentricity necessary for optimum operation.

SUMMARY OF THE INVENTION

In the preferred embodiment, the grinding machine is constructed to shape three basic parts useful in the speed change devices set forth in the above-referenced patents:

(a) an orbital inner element or rotor having an epitrochoidal surface (called the "EPI Orbiting Rotor");

(b) a reaction ring having a hypotrochoidal surface (called the "HYPO Reacting Ring"); and (c) an output ring having a hypotrochoidal surface (called the "HYPO Output Ring").

The first part has two concentric outer circular epitrochoidal races and an inner circular bearing race that is concentric with the two epitrochoidal surfaces. The second part has an inner hypotrochoidal bearing race, an inner circular bearing race and an outer pilot diameter, all of which must be concentric. The last part has an inner hypotrochoidal bearing race, an outer circular bearing race and an inner circular bearing race, all of which must be concentric.

A servomotorized table is arranged to be driven at any selected rotary speed. A second rotary table is mounted on top of first table and is capable of lateral adjustment to provide any desired degree of eccentricity between the rotation centers of the tables. The upper table is driven by a second servomotor so that its speed, relative to the lower table, can be adjusted to any desired speed and in either direction. Three independently controlled grinding spindles, capable of horizontal and vertical adjustment, perform the successive drilling operations.

The true trochoidal contours of the bearing races are generated analogously with high precision under computer control with minimal software. The true contours can be ground as rapidly as if they were circular.

By using the same eccentric adjustment between the two rotary tables and simply changing the synchronization between the tables, the difference between major and minor diameters of the hypotrochoidal and epitrochoidal bearing races will be exactly the same insuring perfect conjugation. Complete grinding operations are performed without moving or relocating the part being machined thus insuring near perfect concentricity of all bearing races.

With simple changes the grinder can accommodate epitrochoidal and hypotrochoidal rings with different pitch diameters and with different numbers of intervening rollers. The machine is completely automatic through the complete grinding cycle and switches from epitrochoidal and hypotrochoidal contour to circular without operator intervention and without any change in the machine setup.

BRIEF DESCRIPTION OF THE DRAWING

FIG. 2 illustrates the EPI Orbiting Rotor positioned on the magnetic clutch affixed to the top of the upper rotary table;

FIG. 3 illustrates the HYPO Reacting Ring positioned on the magnetic clutch;

FIG. 4 illustrates the HYPO Output Ring mounted on the magnetic clutch;

DESCRIPTION OF THE PREFERRED EMBODIMENT

Figure 5:
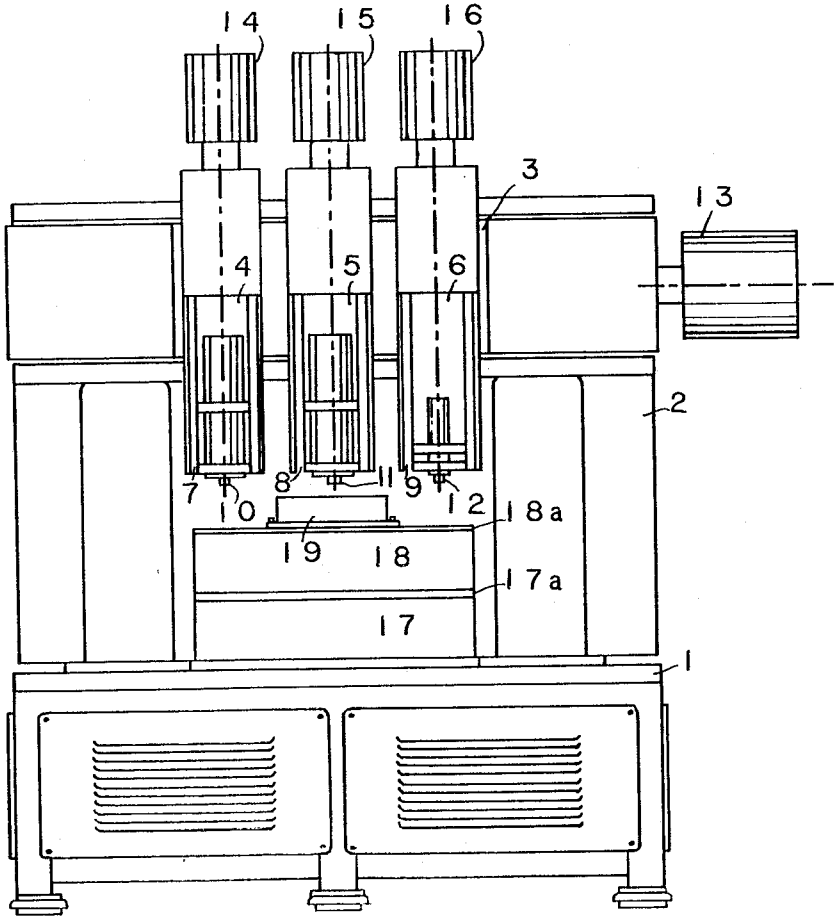
FIG. 5 is a front view of a grinding machine embodying the invention.
Figure 6:
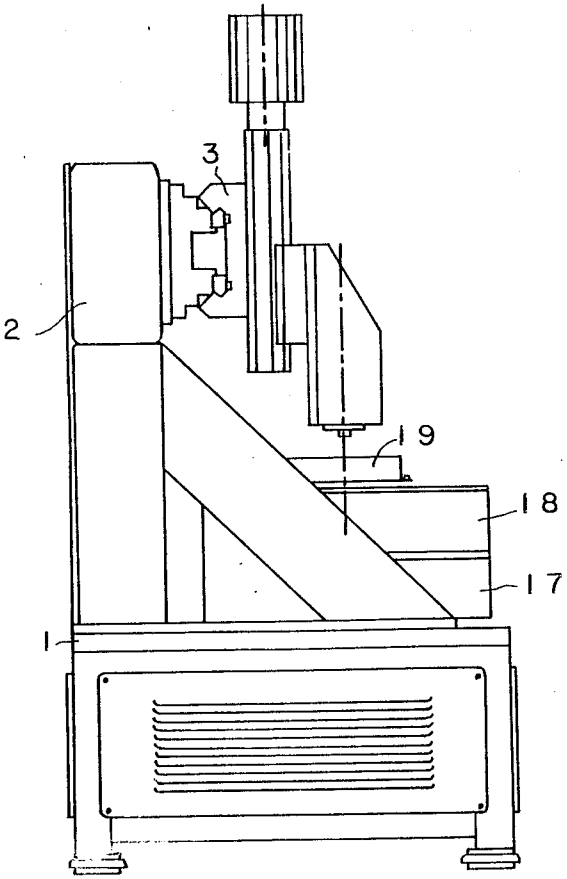
FIG. 6 is a side view of the machine shown in FIG. 5.

As shown in FIGS. 5 and 6, a base 1 supports an upper structure 2 that carries a horizontally-adjustable slide support 3. Three vertically-adjustable slide supports 4, 5 and 6 are rigidly mounted in spaced positions on the support 3. Three grinding support brackets 7, 8 and 9 are respectively mounted for vertical movement on the slide supports 4, 5 and 6. These brackets 7, 8 and 9 in turn respectively carry three motorized grinding spindles 10, 11, and 12.

The horizontal position of the horizontally-slideable support 3 is controlled by a lead screw driven by a servomotor 13. The vertical positions of the brackets 7, 8 and 9 are controlled respectively by means of lead screws operated by servomotors 14, 15 and 16.

A rotary table 17 is mounted on the base 1 and is operated by a servomotor adjustable to any desired speed and direction of rotation. An upper rotary table 18 is mounted on the table 17 and is driven by a separate servomotor by which its speed and direction of rotation can be adjusted relative to the speed and direction of rotation of the table 17. The axis of rotation of the table 18, when in its zero-reference position, is concentric with the axis of rotation of the lower table 17. The table 18, however, is adjustable horizontally with respect to the table 17. By this means, the table 18 can be adjusted to provide the desired degree of eccentricity and then locked in that position. Known mechanisms can be used to provide the rotary and offset movements of the tables 17 and 18. For example, the table 17 can be provided with a rotatable platen 17*a*, controlled by a servo motor (not shown) mounted within the table 17. The upper table 18, is supported on the platen 17*a* and is slideable horizontally with respect to the table 17. The table 18 carries a rotatable platen 18*a* that is driven by a servo motor (not shown) positioned within the table 18. Any other construction that provides two independently controllable mounting tables can be used. To simplify the description from this point on, the tables 17 and 18 will be referred to as the mounting elements and the motions ascribed to them may in fact be the motions of the associated platens 17*a* and 18*a*.

The rotation of the servomotors 13, 14, 15, and 16 and the speed of the servomotorized tables 17 and 18 are each controlled, in known fashion, by a computer (not shown). The lower end of each of the spindles 10, 11 and 12 carries a grinding wheel selected in accordance with the particular grinding function.

Figure 1:
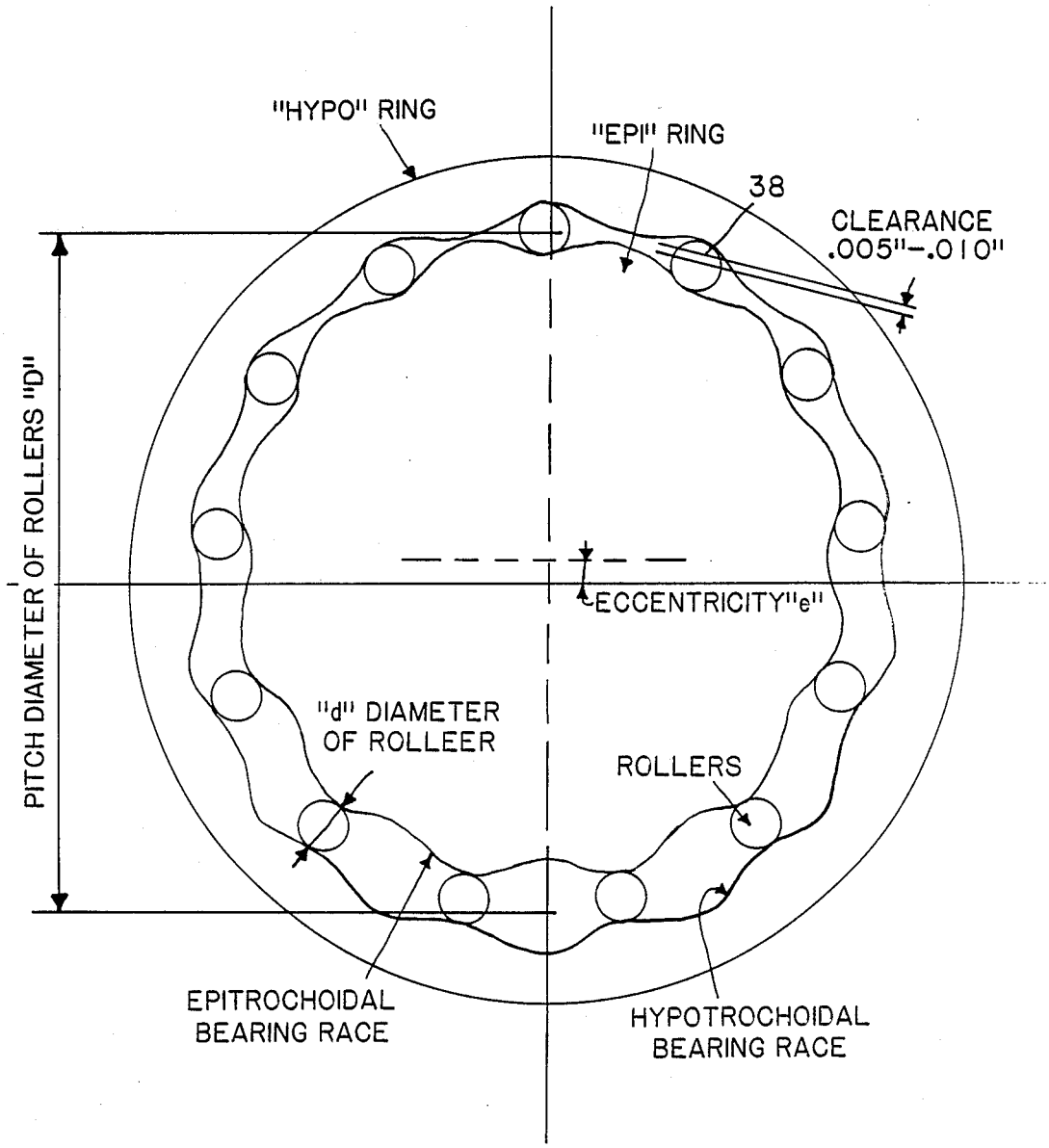
FIG. 1 is a sectional view of a portion of a speed change device, such as is described in the above-referenced patents, showing the hypotrochoidal and epitrochoidal surfaces and the intervening rollers.
Figure 2:
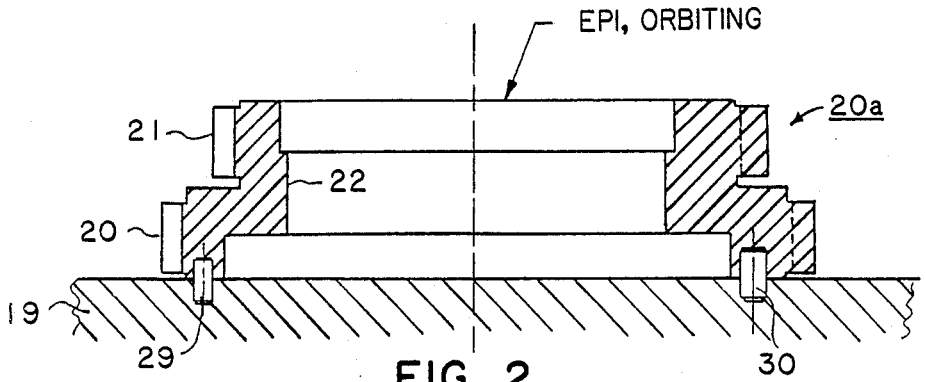
FIGS. 2, 3 and 4 illustrate three different parts that can be made on the particular embodiment of the invention described here.

The part to be formed, in this case the EPI Orbiting Ring shown in FIG. 2, previously rough machined to the approximate size and shape of the finished part, is mounted on a magnetic chuck 19, secured to the top of table 18, in a position concentric with the rotation of the table 18. The trochoidal bearing races are always operated in conjugate sets of two, consisting of the outer epitrochoidal bearing race and the inner hypotrochoidal bearing race, as illustrated by FIG. 1. A set of rollers 38 is interposed between the inner and outer bearing races and are more fully described in the above-referenced patents.

For each conjugated set of hypotrochoidal and epitrochoidal races and the intervening rollers, the trochoidal bearing races are defined by two basic parameters: (a) the number of rollers 38, and (b) the pitch diameter of the rollers 38. The number of rollers is established by the selected speed ratio according to the formula:

$$R=1/[1-((N_i+1)(N_o-1)/(N_i-1)(N_o+1))]$$

where $N_i$ is the number of rollers 38 on the HYPO Reacting Ring and $N_o$ is the number of rollers on the HYPO Output Ring. The pitch diameter of the rollers is selected according to the torque to be transmitted.

From these two parameters, the maximum size of the roller diameter is established and the maximum eccentricity is also established so there will be minimum clearance between the lobes of the epitrochoidal race and its associated hypotrochoidal race. This clearance is typically between 0.005 and 0.010 inches. The number of lobes on the hypotrochoidal race is always $N+1$; the number of lobes on the epitrochoidal race is always $N-1$; the theoretical major diameter of the epitrochoidal race is equal to $D-d+e$; the theoretical minor diameter of the epitrochoidal race is equal to $D-d-e$; the theoretical major diameter of the hypotrochoidal race is equal to $D+d+e$; and the theoretical minor diameter of the hypotrochoidal race is equal to $D+d-e$; where "D" is the pitch diameter of the rollers 38, "d" equals the roller diameter; and "e" equals the eccentricity which is equal to the radius of the orbital path of the inner element.

To grind an EPI Orbiting Rotor, the grinder is prepared as follows: Locating pins 29 and 30 (FIG. 2) are located in the magnetic clutch 19. These pins are of different diameters and are uniquely located to correctly position and orient the blank radially and angularly for grinding. A grinding wheel with a diameter equal or nearly equal to that of the rollers used on the epitrochoidal race 21 is then mounted on the spindle 12. A grinding wheel with a diameter equal to that of the rollers to be used on the epitrochoidal bearing race 20 is mounted on the spindle 11. A cylindrical cup-type grinding wheel with a diameter less than the diameter of the bearing race 22 is mounted on the spindle 10. The rotary table is displaced horizontally from its zero-reference position by a distance equal to one half the eccentricity (e/2) and clamped in place.

The computer is then programmed, in known manner, so the two rotary tables 17 and 18 are synchronized as follows:

For each rotation of the rotary table 17, the upper rotary table 18 will rotate in the opposite direction at a speed equal to that of the rotary table 17 minus $1/(N-1)$ turn, where N is the number of rollers. The speed ratio between rotary tables 17 and 18 is then equal to $1-(1/(N-1)$ with the two table always rotating in opposite directions.

The operating cycle is as follows:

(a) The rotary tables are stopped at a rotary position called "home".

(b) The blank for the EPI Orbiting Rotor is placed on the magnetic chuck 19 on the locating pins 29 and 30.

(c) The spindle 12, with the grinding wheel in place, is started and moved to approach the epitrochoidal bearing race 21.

(d) The rotary tables 17 and 18 start to rotate in synchronism, as set forth above.

(e) The grinding wheel on the spindle 12 is rotating and adjustment of the slide support 6 brings it to the appropriate height with respect to the epitrochoidal bearing race 21. The servomotor 16 controls the height adjustment. In addition, a short-stroke oscillatory movement, along the axis of the spindle 12, is imparted to the grinding wheel through the servomotor to provide a smooth, cross-hatched finish on the surface of the epitrochoidal bearing race 21. Because the blank for the EPI Orbiting Rotor has been oriented angularly and centered on the rotary table, and because of the pre-set eccentricity of the rotary table 18 with respect to the table 17, and because of the synchronized angular motion of the two rotary tables 17 and 18, the surface of the rough machined epitrochoidal bearing race 21 follows a path that is a constant distance from the grinding wheel. When the grinding wheel comes in contact with the surface of the epitrochoidal bearing race 21, it is like grinding a smooth circle, the "bumps" and "valleys" of the epitrochoidal surface having been offset by the motion generated by the two rotary tables. The epitrochoidal contour is thus analagously generated with utmost precision. The major diameter of the epitrochoidal bearing race 21 is controlled by the lateral displacement of the slide support 3, which is controlled by the servomotor 13. The minor diameter is generated automatically as a function of the major diameter and is equal to the major diameter minus two times the pre-set eccentricity of the rotary table 18. When the correct major diameter is reached the grinding wheel is retracted to terminate the first grinding operation.

(f) The two rotary tables stop and restart under a new synchronization reflecting the different number of rollers. The eccentricity between the rotary tables 17 and 18 remains unchanged.

(g) The spindle 11 is started and a similar cycle is repeated for grinding the epitrochoidal bearing race 20.

(h) The bottom rotary table 17 stops at home position: the top rotary table 18 keeps turning.

(i) The spindle ten is then rotated and moved to grind the internal face 22 of the epitrochoidal bearing races 20 and 21.

The finished part is then removed from the magnetic chuck 19 and each of the grinding spindles is retracted. The two rotary tables 17 and 18 are each returned to the home position. The machine is then ready to process another EPI Orbiting Rotor.

Figure 3:
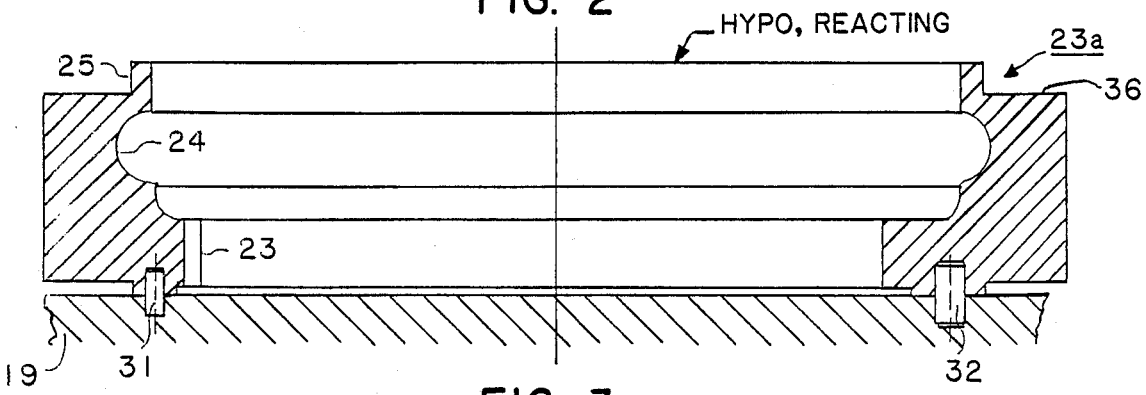

To grind a HYPO Reacting Ring, shown in FIG. 3, the grinding machine is prepared as follows: The two rotary tables 17 and 18 are synchronously programmed so that for each turn of the bottom table 17, the upper rotary table 18 will rotate in the opposite direction one turn plus $1/(N+1)$ turn, where N is the number of rollers. The speed ratio between between the tables 17 and 18 is then equal to $1+[1/(N+1)]$, with the two tables always turning in opposite directions. The spindle 12 is fitted with a grinding wheel having a diameter equal or nearly equal to that of the roller to be used on the hypotrochoidal bearing race 23. The spindle 11 is fitted with a form grinding wheel to grind the bearing race 24. The spindle 10 is fitted with a cup-type cylindrical grinding wheel to grind the pilot diameter 23.

The grinding cycle of the machine is as follows:

(a) The two rotary tables 17 and 18 are stationary at the home position.

(b) The rough machined blank for the HYPO Reacting Ring is placed on the magnetic chuck 19 and located radially and angularly by the pins 31 and 32.

(c) The spindle 12 is started and moved into position at the appropriate height and near the hypotrochoidal bearing race 23.

(d) The two rotary tables 17 and 18 begin synchronized rotation. The grinding wheel on spindle 12 begins the grinding of the hypotrochoidal bearing race 23 as if it were a smooth, continuous circular surface because the motion is generated by the two synchronized tables to accurately generate the contour of the hypotrochoidal race. Preferably, a vertical oscillation is imparted to the grinding wheel to provide a smooth cross-hatched finish on the bearing race surface. When the minor dimension has been reached, the spindle 12 is moved out and retracted.

(e) The bottom rotary table 17 stops at its home position, while the table 18 continues to rotate.

(f) The spindle 11 moves into position and form-grinds the bearing race 24. The diameter of the bearing race is provided by the computer program, in known manner, and is controlled by the servomotor 13.

(g) When the correct diameter of the race 24 is reached, the spindle 11 backs off and is retracted.

(h) The spindle 10 moves into position and grinds the pilot diameter 25 and the face 36 and retracts.

(i) The rotary table 18 stops at its home position and the completed part is removed from the chuck 19.

Figure 4:
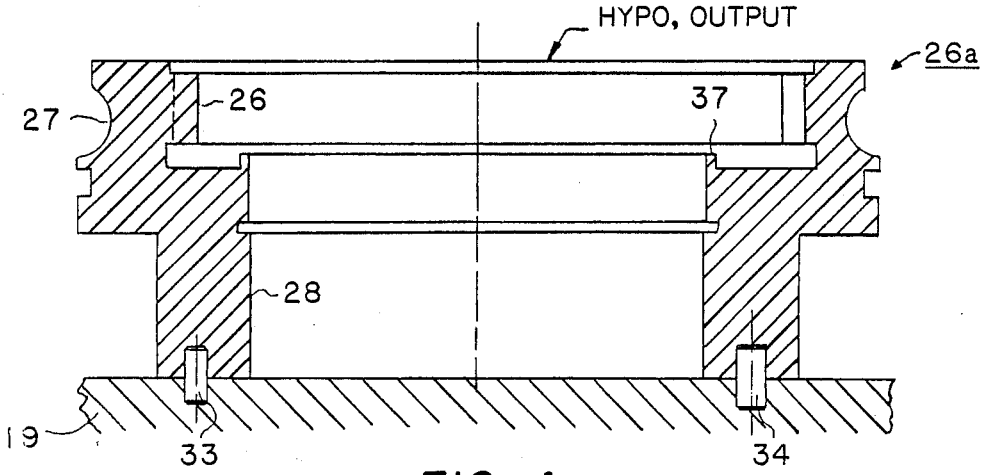

To grind the HYPO Output Ring 26*a* (FIG. 4), the machine will be prepared as follows: The eccentricity of the two rotary tables is not changed, but the synchronization is modified according to the new number of rollers with the ratio being equal to $1+[1/(N+1)]$, where N is the number of rollers. The spindle 12 is fitted with a grinding wheel having a diameter equal or nearly equal to that of the rollers to be used on the hypotrochoidal bearing race 26. The spindle 11 is fitted with a cup-type cylindrical grinding wheel with a diameter smaller than the diameter of the bearing race 28. The spindle 10 is fitted with the same form grinding wheel as was used to grind the bearing race 24 of the HYPO Reacting Ring 23*a*.

The grinding cycle is as follows:

(a) The two rotary tables 17 and 18 are stopped at the home positions.

(b) The rough-machined blank for the HYPO Output Ring is placed on the magnetic chuck 19 and is located by means of the pins 33 and 34.

(c) The two rotary tables 17 and 18 are driven in synchronization.

(d) The grinding spindle 12 moves into position and starts grinding the hypotrochoidal bearing race 26. When the minor diameter dimension is reached, the spindle 12 is backed out and retracted.

(e) The bottom table 17 is stopped at its home position while the top table 18 continues to rotate.

(f) The spindle 11 brings the form-grinding wheel into position and grinds the bearing race 27. The final diameter of the bearing race is controlled by the lateral displacement of the slide support 3 which in turn is controlled by the servomotor 13, under control of the computer program.

(g) When the correct diameter of the bearing race 27 is reached, the grinding wheel backs up and is retracted.

(h) The spindle 10 is then started and moved into position to grind the bearing race 28, whose diameter is under the control of the horizontal slide support and servomotor 13 as directed by the computer program.

(i) The table 18 stops rotation at the home position and the finished part is removed. The machine is then ready for grinding another HYPO Output Ring.

I claim:

1. In a machine for grinding a machine blank into a finished part having a plurality of machined surfaces, the combination comprising a first rotary table, first drive means for continuously rotating said first table in one direction about a first axis, a second rotary table, means supporting said second table on a surface of said first table, second drive means for continuously and simultaneously rotating said second table relative to said first table in one direction about an axis parallel with said first axis, a grinding spindle, means for adjusting the relative positions of said spindle and said first and second tables in at least one direction, third drive means for rotating said spindle, a grinding wheel, means for securing said grinding wheel to said spindle, and means for securing said blank to said second table in a position to be finished by said grinding wheel.

2. A grinding machine as claimed in claim 1 wherein said second drive means includes means for rotating said second table in a direction opposite from the direction of rotation of said first table.

3. A grinding machine as claimed in claim 2 wherein said means for securing said blank to said second table is a magnetic clutch.

4. A grinding machine as claimed in claim 2 including a plurality of grinding wheels each adapted to be individually adjusted in two directions and to individually engage said bank, and means for selectively driving said grinding wheels.

5. A machine for grinding a machine blank into a finished part having a plurality of machined surfaces, said part including a hypotrochoidal bearing race for use in a speed change device in which a rotor having an epitrochoidal outer circumference is mounted on an eccentric mounted for orbital rotation within said hypotrochoidal race and is separated therefrom by a plurality of spaced rollers in engagement both with said hypotrochoidal bearing race and said epitrochoidal surface, including a first rotary table, first drive means for rotating said first table, a second rotary table, means supporting said second table on a surface of said first table, second drive means for rotating said second table relative to said first table, said second drive means including means for rotating said second table in a direction opposite from the direction of rotation of said first table, a grinding spindle, means for adjusting the relative positions of said spindle and said first and second tables in two directions, third drive means for rotating said spindle, a grinding wheel, said grinding wheel having a diameter approximately equal to the diameter of one of said rollers, means for securing said grinding wheel to said spindle, and means for securing said blank to said second table in a position to be finished by said grinding wheel.

6. A grinding machine as claimed in claim 5 wherein the axis of rotation of said second table is offset from the axis of rotation of said first table by a distance equal to one-half of the radius of the orbital path of said rotor.

7. A grinding machine as claimed in claim 6 wherein the speed of said second rotary table during the grinding operation is equal to the speed of said first rotary table plus $1/(N+1)$, where N is the number of rollers to be positioned between said hypotrochoidal bearing race and said epitrochoidal surface.

8. A grinding machine as claimed in claim 2 wherein said machined part includes a rotor having a rotor with an outer epitrochoidal surface for use in a speed change device in which a hypotrochoidal bearing race surrounds said rotor, said rotor being mounted on an eccentric for orbital rotation within said hypotrochoidal race and is separated therefrom by a plurality of spaced rollers in engagement both with said hypotrochoidal bearing race and said epitrochoidal surface, and the speed of said second table during the grinding operation is equal to the speed of said first table minus $1/(N-1)$ where N is equal to the number of rollers to be positioned between said hypotrochoidal bearing race and said epitrochoidal surface.

* * * * *